US007176640B2

(12) United States Patent
Tagawa

(10) Patent No.: US 7,176,640 B2
(45) Date of Patent: Feb. 13, 2007

(54) DEVICE FOR CONTROLLING LIGHT EMISSION RATES OF A BACKLIGHT

(75) Inventor: Yasuhiro Tagawa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/204,351

(22) Filed: Aug. 16, 2005

(65) Prior Publication Data

US 2006/0038511 A1 Feb. 23, 2006

(30) Foreign Application Priority Data

Aug. 18, 2004 (JP) ..... 2004-238790

(51) Int. Cl.
*H05B 37/02* (2006.01)

(52) U.S. Cl. ..... 315/308; 315/309

(58) Field of Classification Search ..... 315/185 R, 315/291, 307, 308, 309, 312; 345/102; 349/62, 349/69; 362/234, 253, 561
See application file for complete search history.

(56) References Cited

U.S. PATENT DOCUMENTS 6,510,995 B2 * 1/2003 Muthu et al. ..... 235/454
6,753,661 B2 * 6/2004 Muthu et al. ..... 315/307
6,930,737 B2 * 8/2005 Weindorf et al. ..... 349/69

FOREIGN PATENT DOCUMENTS

JP 06-301034 10/1994

* cited by examiner

*Primary Examiner*—Thuy Vinh Tran
(74) *Attorney, Agent, or Firm*—Rader, Fishman & Grauer PLLC

(57) ABSTRACT

A control device can stably control the quantity of the emitted light of a backlight unit by means of a simple arrangement. The control device comprises an electric current supply section for supplying a predetermined drive current to a group of light emitting elements, a quantity of emitted light detecting section for detecting the quantity of light emitted from the group of light emitting elements, a temperature detecting section for detecting the temperature of the backlight unit, a reference quantity of light outputting section for outputting a reference quantity of light for the light emitting elements of each color and a control section for controlling the electric current supply section so as to make it supply a constant drive current to the light emitting elements of blue color according to the quantity of emitted light detected by the quantity of emitted light detecting section, the temperature detected by the temperature detecting section, and the reference quantity of light output from the reference quantity of light outputting section and supply a predetermined drive current to the light emitting elements of red color and those of green color according to the constant drive current supplied to the light emitting elements of blue color.

5 Claims, 8 Drawing Sheets

DEVICE FOR CONTROLLING LIGHT EMISSION RATES OF A BACKLIGHT

CROSS REFERENCES TO RELATED APPLICATIONS

The present invention contains subject matter related to Japanese Patent Application JP 2004-238790 filed in the Japanese Patent Office on Aug. 18, 2004, the entire contents of which are incorporated herein by reference.

BACKGROUND OF THE INVENTION

1. Field of the Invention

The present invention relates to a control device that is installed in a liquid crystal display apparatus and the like and that controls the light emission rate of the backlight thereof.

2. Description of the Related Arts

Like self-emission-type PDPs (plasma display panels), liquid crystal display apparatuses are being popularly used in television sets and various displays because they can provide a large display screen and have many other advantages, such as being lightweight, thin and of a low power consumption rate when compared with display apparatuses comprising a CRT (cathode ray tube). A liquid crystal display apparatus has a pair of transparent substrates of a size selected from a number of sizes conforming to standards, and liquid crystal is filled in the gap separating them from each other and held in a hermetically sealed condition. Then, the apparatus optically displays a given image as a voltage is applied to the transparent substrates to change the directions of the liquid crystal molecules and hence the transmittance of light of each of the molecules.

Since liquid crystal itself is not a light emitting body, a liquid crystal display apparatus is provided typically on the rear surface of the liquid crystal panel thereof with a backlight unit that operates as a light source. The backlight unit typically as a primary light source, a photoconductive plate, a reflector film, and a lens sheet or a diffusion film so that displaying light is supplied to the entire surface of the liquid crystal panel. In the past, a CCFL (cold cathode fluorescent lamp) containing mercury or xenon in a fluorescent tube in a hermetically-sealed condition was used as a primary light source. However, cold cathode fluorescent lamps have a number of problems to be resolved. They include a low luminance of emitted light, a short service life and a poor uniformity of light because of the existence of a low luminance region at the cathode side.

Large liquid crystal display apparatuses are generally provided with an area-lit configuration backlight unit that is formed by arranging a plurality of long cold cathode fluorescent lamps on the rear side of a diffusion plate in order to supply displaying light to the liquid crystal panel. However, such area-lit configuration backlight units are required to dissolve the above-identified problem attributable to cold cathode fluorescent lamps. Particularly, the requirement of high luminance and high uniformity is remarkable in the case of large television sets having a display screen greater than 40 inches.

LED area lit backlights formed by two-dimensionally arranging a large number of light emitting diodes (to be referred to as LED hereinafter) of three primary colors of light of red, green and blue on the rear surface of a diffusion film in place of the above described cold cathode fluorescent lamps are attracting attention. Such LED backlight units are being used in large liquid crystal panels to display images with an enhanced degree of luminance because they can be manufactured at low cost due to the falling cost of LEDs and operate with a low power consumption rate.

In various backlight units, various optical members including an optical function sheet block for changing the function of display light emitted from the light source, a diffusion/light guide plate, a light diffusion plate and a reflection sheet are arranged between the light source unit and the transmission-type liquid crystal panel. The light diffusion plate of the backlight unit is typically made of transparent acrylic resin and provided with a lighting control pattern that operates to partly transmit and partly reflect display light striking a site located opposite to the light source. Patent Document 1 [Japanese Patent Application Laid-Open Publication No. Hei 6-301034] describes a backlight unit comprising a light diffusion plate provided with a plurality of belt-shaped light control patterns arranged in a region located opposite to a fluorescent tube, each of the plurality of belt-shaped light control patterns being formed by a large number of reflection dots. On the light diffusion plate, the reflection dots are formed in such a way that the area of dots decreases as the distance of the dot from the axial line of the fluorescent tube increases. With this arrangement, the transmittance of light increases as the distance from the fluorescent tube increases so that consequently uniformized light is emitted as a whole.

Meanwhile, LEDs have the characteristics that the luminance degradation characteristics thereof change as the internal temperature rises and falls and LEDs of different colors have different sets of characteristics. Therefore, for the LEDs of each color to maintain the same and constant luminance level, it is necessary to detect the variation of luminance of the LEDs of each color by means of an optical sensor and correct the light emission rate of the LEDs of each color according to the detected value in a controlled manner.

Generally, the control device of an LED backlight unit is adapted to conduct a feedback control operation so as to make the LEDs of green color maintain the same and constant luminance level and the LEDs of red color and those of blue color are corrected for luminance in a controlled manner.

When correcting the LEDs for luminance, it is necessary to consider the change in the junction temperature $\theta j$ that arises due to the temperature change in the LEDs of green color. If the range of change of the junction temperature $\theta j$ is between 35° C. and 95° C., it is necessary to conduct a feedback control operation so as to increase the electric current being supplied to the LEDs of green color by more than 50%.

Additionally, the light emission efficiency of LEDs falls as the operation hours increase. For example, when an LED is driven to operate for light emission for about fifty thousands hours, while maintaining the junction temperature at a constant level of 90° C., its light emission efficiency falls to about 70° C. of the initial level. Therefore, when LEDs are used as a light source in a television set, it is necessary to raise the electric current supplied to the LEDs as a function of the total operation hours of the LEDs in order to maintain the luminance of the LEDs at a constant level. Still additionally, when the electric current is supplied to the LEDs of green light to a predetermined value (tolerance limit), it is no longer possible to correct the luminance thereof. Thus, the service life of the LEDs of green light comes to end when it is no longer possible to correct the luminance of the LEDs.

To avoid this problem, a control device 30 for controlling the light emission rate of LEDs typically comprises photosensors 31*a*, 31*b* for detecting the light emission rate of each of the LEDs, a temperature sensor 32 for detecting the quantity of heat of the backlight unit, a sensor input section 33 to be used for inputting the detected values of the photo-sensors 31*a*, 31*b* and the temperature sensor 32, a memory 34 storing the service life degradation curve and the temperature characteristic curve of LEDs of green light, a service life timer 35 for counting the total light emission hours of the LEDs, a SW/ON timer 36 for counting the elapsed light emission hours of the LEDs each time the power source is turned ON, a reference quantity of light outputting section 37 for outputting the quantity of emitted light that provides a reference for the LEDs of each color, a set conditions determining section 38 for determining the conditions of LED backlight to be set, an electric current supply section 39 for supplying an electric current to each LED according to the outcome of the determination of the set conditions determining section 38 and an operation section 40 for generating operation signals, and operates to control the backlight unit.

The set conditions determining section 38 performs a predetermined arithmetic operation on the basis of the detected values that are input to the sensor input section 33, the count value of the service life timer 35, the count value of the SW/ON timer 36 and the service life degradation curve and the temperature characteristic curve of LEDs of green light stored in the memory 34 and compares the computed value obtained as a result of the arithmetic operation and the reference value output from the reference quantity of light outputting section 37. Then, it determines the conditions of LED backlight to be set on the basis of the outcome of the comparison.

Thus, the control device 30 having the above-described configuration conducts feedback control operations for gradually lowering the target value for the luminance of each LED along the service life degradation curve stored in the memory 34 so that the value of the electric current supplied to each LED does not reach the tolerance limit and hence it is possible to maintain the balance of RGB for a long period of time.

OBJECTS AND SUMMARY OF THE INVENTION

Meanwhile, when the light emission efficiency of LEDs of green color changes, it is difficult to determine if the change is attributable to the terminating service life, the change in the junction temperature or the external environment. Therefore, the control device 30 needs to be provided with a SW/ON timer 36 for counting the elapsed light emission hours of the LEDs each time the power source is turned ON and to have a complex program installed therein for the purpose of observing the environment temperature and determining the target value to be fed back by taking the observed temperature into consideration.

In view of the above-identified problem of the related art, it is therefore desirable to provide a control device of a backlight unit that can stably correct the chromaticity of the LED backlight of the backlight unit by means of a simple arrangement.

According to the present invention, there is provided a control device for controlling a backlight unit having a group of light emitting elements including light emitting elements of red color, light emitting elements of green color and light emitting elements of blue color, the light emitting elements of different colors being electrically connected separately, and the control device comprising: an electric current supply means for supplying a predetermined drive current to the group of light emitting elements; a quantity of emitted light detecting means for detecting the quantity of light emitted from the group of light emitting elements as a function of the electric current supplied from the electric current supply means; a temperature detecting means for detecting the temperature of the backlight unit; a reference quantity of light outputting means for outputting a reference quantity of light for the light emitting elements of each color; and a control means for controlling the electric current supply means so as to make it supply a constant drive current to the light emitting elements of blue color according to the quantity of emitted light detected by the quantity of emitted light detecting means, the temperature detected by the temperature detecting means, and the reference quantity of light output from the reference quantity of light outputting means and supply a predetermined drive current to the light emitting elements of red color and those of green color according to the constant drive current supplied to the light emitting elements of blue color.

Preferably, a control device according to the invention further comprises: an operation signal generating means for generating a predetermined operation signal; the electric current supply means being adapted to make the value of the constant drive current supplied to the light emitting elements of blue color variable to any electric current value under the control of the control means according to the operation signal and also the drive current supplied to the light emitting elements of red color and those of green color according to the electric current value made variable.

Preferably, the operation signal generating means generates an operation signal for manipulating the luminance of the backlight.

Preferably, the operation signal generating means generates an operation signal for manipulating the color temperature of the backlight.

Thus, a control device according to the invention can conduct a feedback operation on the electric current supplied to the red LEDs and the green LEDs according to the detection output of the optical sensor for the blue LEDs by maintaining the electric current supplied to the blue LEDs that show relatively little temperature changes to a constant level and hence can be used to form a simple feedback system.

DETAILED DESCRIPTION OF THE PREFERRED EMBODIMENTS

Figure 1:
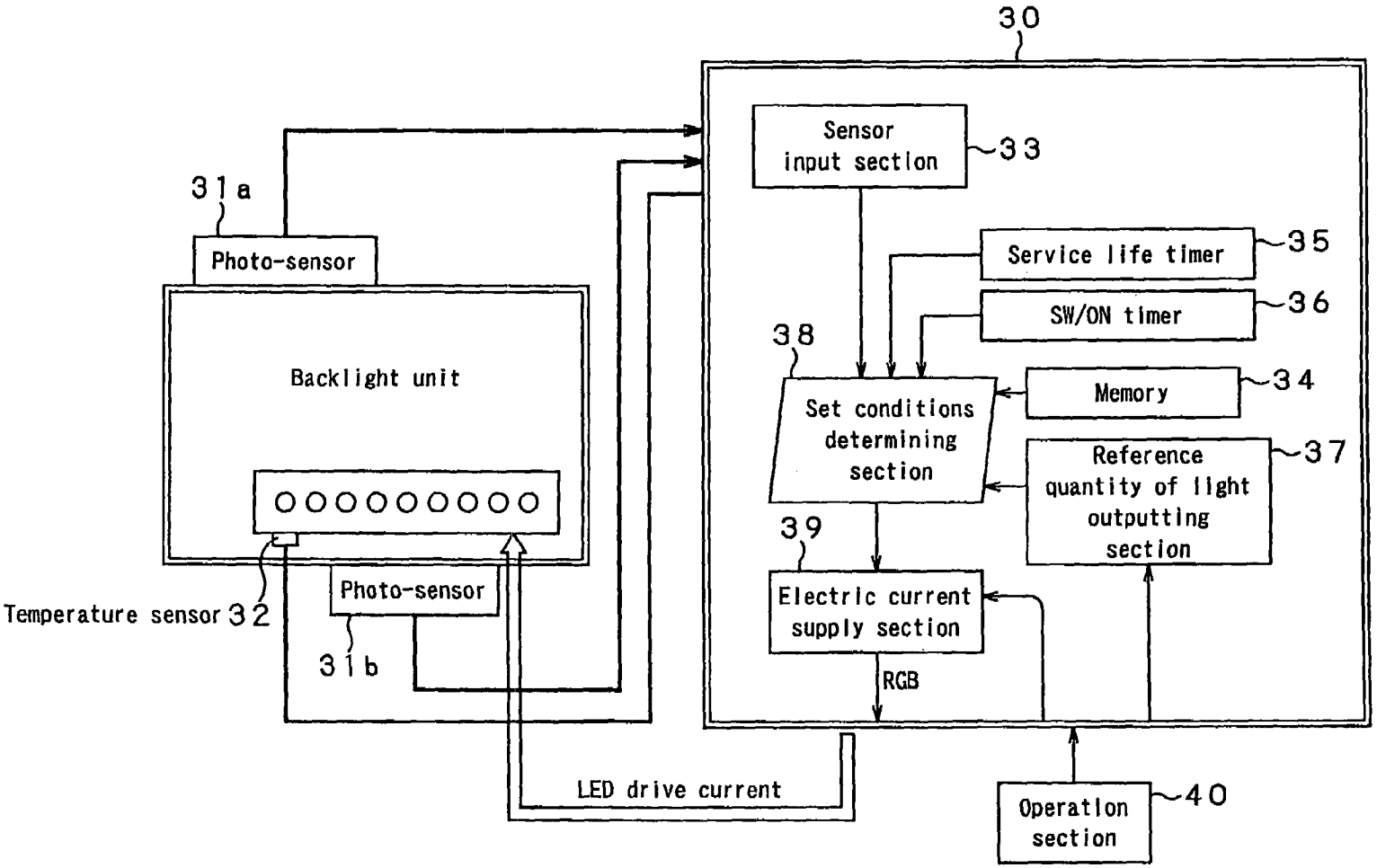
FIG. 1 PRIOR ART
FIG. 1 is a schematic block diagram of a known control device for adjusting the quantity of emitted light of a backlight unit.
Figure 2:
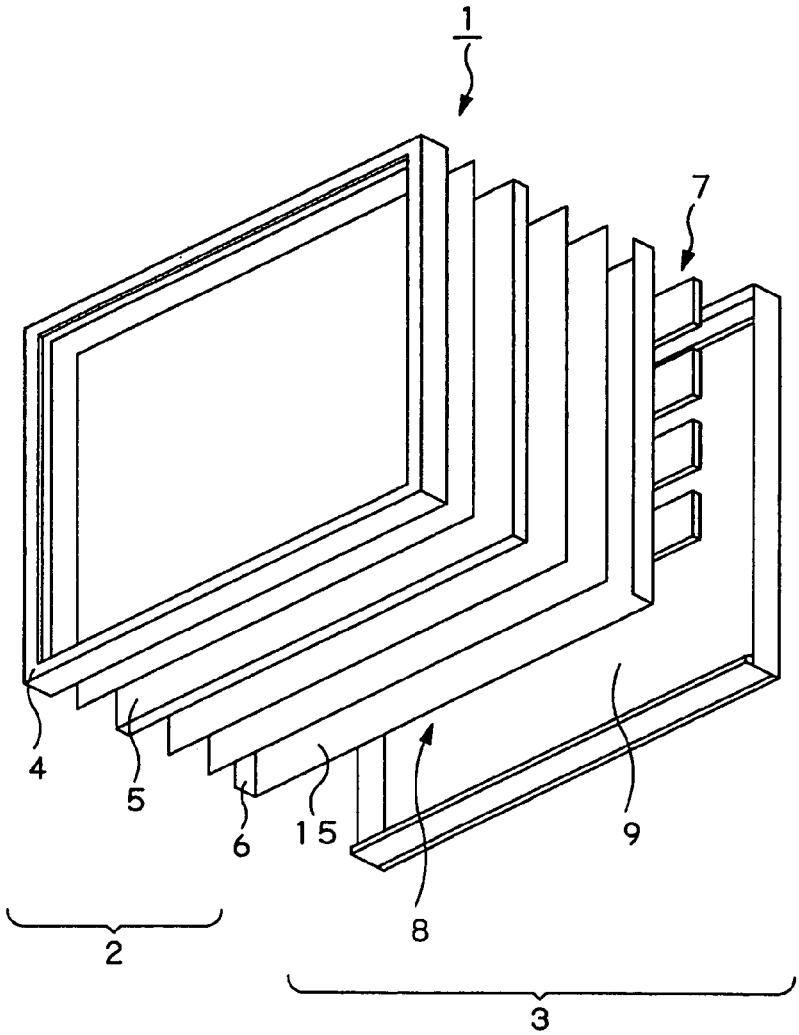
FIG. 2 is an exploded schematic perspective view of a transmission-type liquid crystal display panel to which an embodiment of the present invention is applied.
Figure 4:
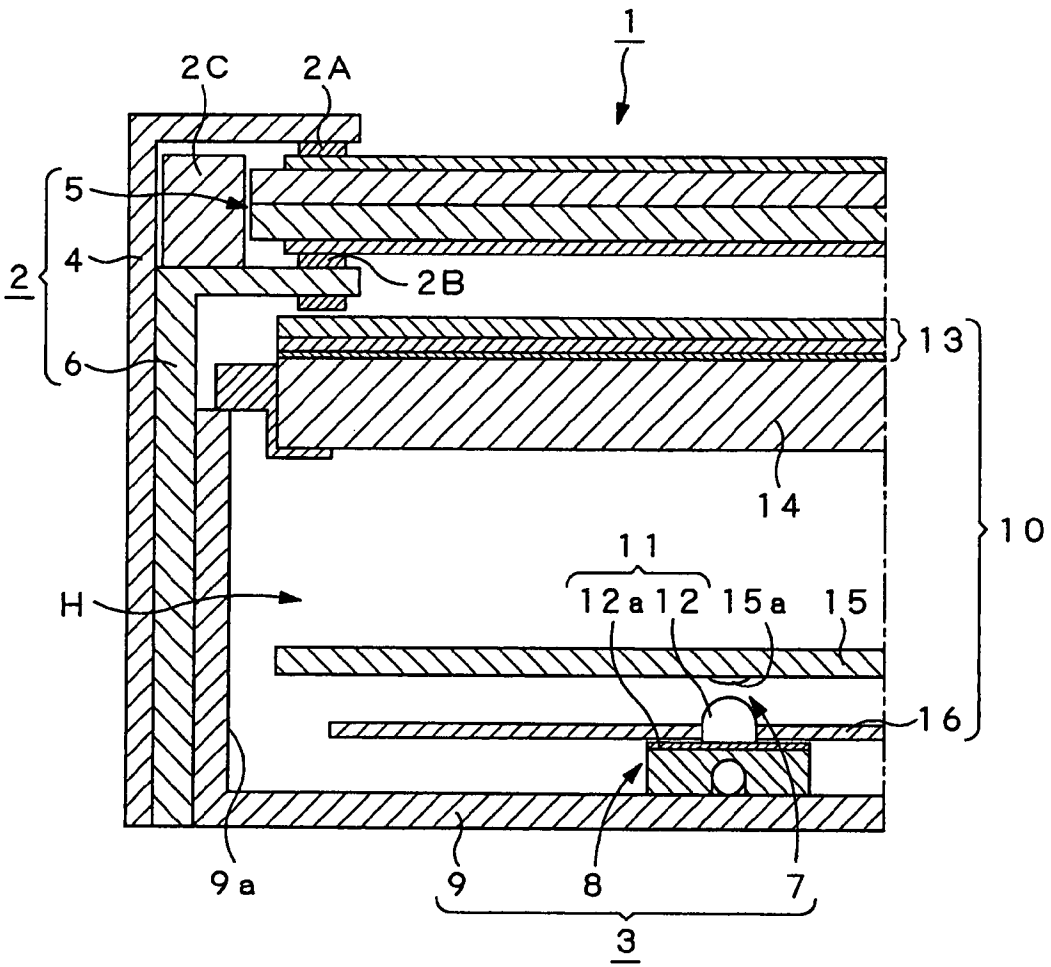
FIG. 4 is a schematic cross-sectional view of a principal part of the transmission-type liquid crystal display panel of FIG. 2.

Now, the present invention will be described by referring to the accompanying drawings that illustrates a preferred embodiment of a control device according to the invention that is installed in a transmission-type liquid crystal display panel. The transmission-type liquid crystal display panel 1 is used in a television set having a large display screen that is typically not smaller than 40 inches. Referring to FIGS. 2 and 4, the transmission-type liquid crystal display panel 1 comprises a liquid crystal panel unit 2 and a backlight unit 3 fitted to the rear side of the liquid crystal panel unit 2 to supply display light to the panel unit 2. The liquid crystal panel unit 2 includes a front frame member 4, a liquid crystal panel 5, and a rear frame member 6, the front frame member 4 and the rear frame member 6 being adapted to hold the liquid crystal panel 5 along the outer peripheral edges thereof by pinching it between them by way of spacers 2A, 2B and guide members 2C.

Although not show in detail, the liquid crystal panel 5 includes a first glass substrate and a second glass substrate arranged vis-à-vis and separated from each other by means of spacer beads or the like and liquid crystal is filled in the gap and held there in a hermetically sealed condition. A voltage is applied to the liquid crystal to change the orientations of the liquid crystal molecules and the optical transmittance of the liquid crystal. In the liquid crystal panel 5, a stripe-shaped transparent electrode, an insulation film and an orientation film are formed on the inner surface of the first glass substrate, whereas color filters of the three primary colors, an overcoat layer, a stripe-shaped transparent electrode and an orientation film are formed on the inner surface of the second glass substrate. Additionally, in the liquid crystal panel 5, a deflection film and a phase difference film are bonded respectively to the surface of the first glass substrate and the surface of the second glass substrate.

In the liquid crystal panel 5, the orientation film that is made of polyimide is adapted to arrange the liquid crystal molecules on the interface thereof in a horizontal direction, while the deflection film and the phase difference film turn the wavelength characteristics into those of achromatic color, or white color, and a full color image is produced by color filters to display the color image, which may typically be a received image. However, the structure of the liquid crystal panel 5 is not limited to the above described one and may alternatively have a structure the same as that of any known liquid crystal panel.

The backlight unit 3 includes a light emission unit 7 arranged at the rear surface side of the above-described liquid crystal panel unit 2 to supply display light, a heat emission unit 8 for emitting the heat generated in the inside of the light emission unit 7 and a back panel 9 for holding the light emission unit 7 and the heat emission unit 8, the back panel 9 also operating as a fitting member of a cabinet when combined with the frame member 4 and the rear frame member 6. The backlight unit 3 has such outer dimensions that make it opposed to the entire rear surface of the liquid crystal panel unit 2 and is combined with the latter so as to optically tightly close the space interposed between them.

The light emission unit 7 of the backlight unit 3 is formed by arranging an optical sheet block 10 and a light emission block 11 having a large number of light emitting diodes. The light emission block 11 will be described in greater detail hereinafter. The optical sheet block 10 is arranged opposite to the rear surface of the liquid crystal panel 5 and includes an optically functional sheet laminate 13 formed by laying various optically functional sheets such as a polarization film, a phase difference film, a prism sheet or a diffusion film one on the other, a light diffusion/guide plate 14, a diffusion plate 15 and a reflection sheet 16 for reflecting light along with other components. The optically functional sheet laminate 13 is formed by laying a plurality of optically functional sheets having optical functions such as a functional sheet that decomposes display light supplied from the light emission block 11 to strike the liquid crystal panel 5 into a perpendicularly-polarized component, a functional sheet that compensates the phase difference of light wave to prevent a broadened view field and coloring and a functional sheet that diffuses display light and so on, although they will not be described in greater detail. Note, however, the component sheets of the optically functional sheet laminate 13 are not limited to the above listed ones and may additionally or alternatively include a luminance improving film for improving the luminance and/or a pair of upper and lower diffusion sheets arranged to sandwich the phase difference film and the prism sheet.

Figure 3:
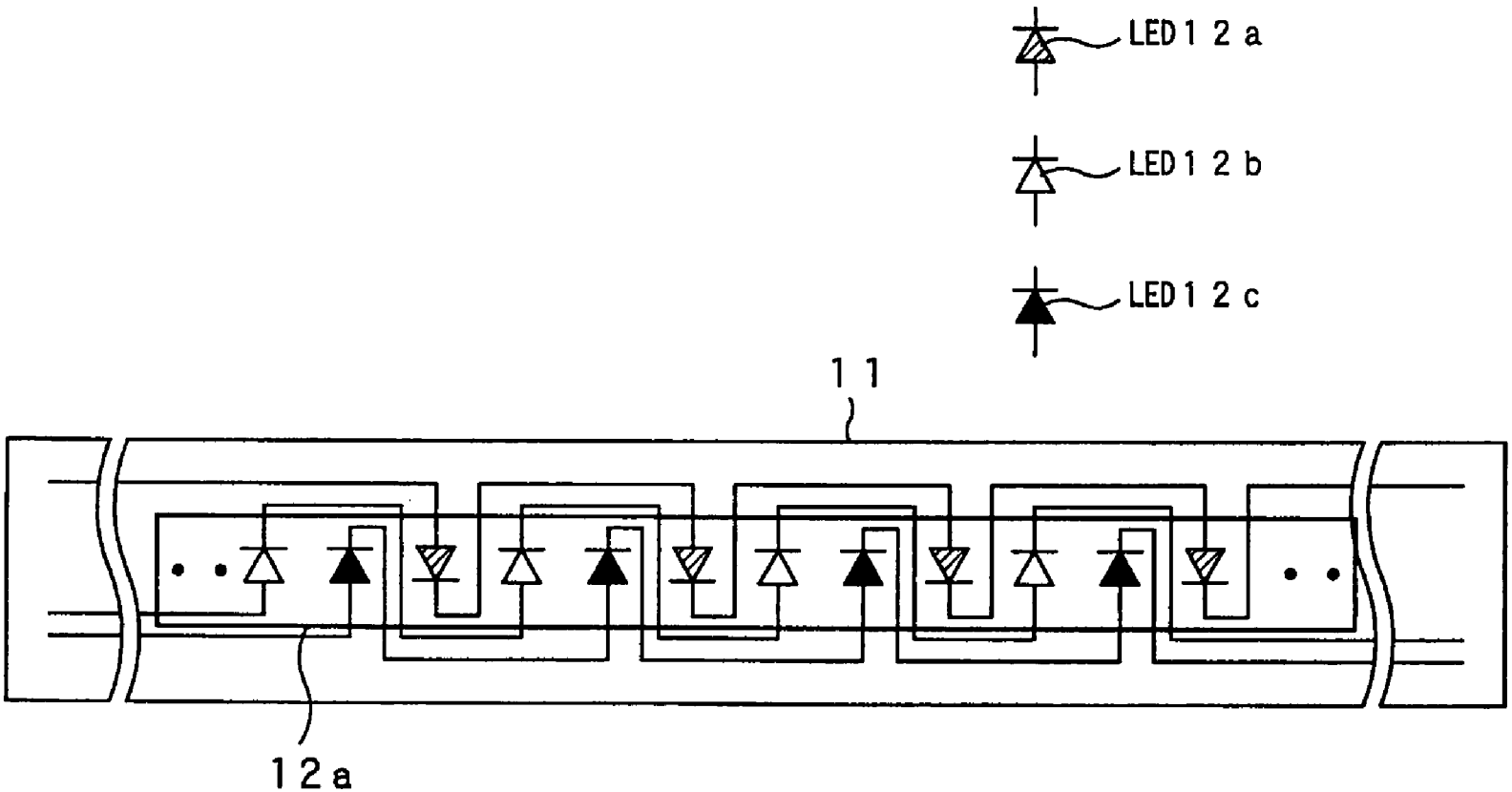
FIG. 3 is a schematic illustration of a light emitting block, showing the configuration thereof.

The light emission block 11 includes red LEDs 12*a*, green LEDs 12*b* and blue LEDs 12*c* whose numbers are appropriately selected, the LEDs being arranged in array with the polarities of the LEDs of each color uniformly directed in a same direction as illustrated in FIG. 3 as an example of arrangement. The backlight unit 3 of this embodiment is formed by a total of 18 light emission blocks 11, each having a total of 25 LEDs and operating as a unit.

Note that the arrangement of LEDs 12 in FIG. 3 is only an example. The number of LEDs of each unit and the combinations of the LEDs of different colors that are mounted in a liquid crystal display apparatus are appropriately selected depending on the size of the display screen and the light emitting capacity of each LED 12.

In the optical sheet block 10, the light diffusion/guide plate 14 is arranged as a laminate at the main surface side of the optically functional sheet laminate 13 that is located vis-à-vis the liquid crystal panel 5. Display light supplied from the light emission block 11 strikes the light diffusion/guide plate 14 from the rear surface side thereof. The light diffusion/guide plate 14 is a plate having a considerably large thickness and is typically formed by transparent synthetic resin having light guiding property, for example, molding acrylic resin or polycarbonate resin. The light diffusion/guide plate 14 diffuses display light that enters it from one of the main surface sides thereof by refracting and reflecting it in the inside thereof and makes it strike the optically functional sheet laminate 13 from the other main surface side thereof. As shown in FIG. 4, the light diffusion/guide plate 14 is fitted to the outer peripheral wall 9*a* of the back panel 9 with the optically functional sheet laminate 13 by way of a bracket member 14A.

In the optical sheet block 10, the diffusion plate 15 and the reflection plate 16 are fitted to the pack panel 9, and both the gap separating them from each other and the gaps separating them respectively from the light diffusion/guide plate 14 are maintained by a large number of optical stud members (not shown). The diffusion plate 15 is a plate formed typically by molding a transparent synthetic resin material, such as acrylic resin, and adapted to receive display light supplied from the light emission block 11. A large number of dimmer dots 15*a* are arranged in array and respectively disposed opposite to the so many number of LEDs 12 of the light emission block 11 that are also arranged in array as will be described in greater detail hereinafter.

On the diffusion plate 15, the dimmer dots 15*a* are formed by printing a dot pattern of circular dots on the surface of the plate 15 typically by screen printing, using ink prepared by mixing a light-blocking agent such as titanium oxide or barium sulfide and a diffusion agent such as glass powder or silicon oxide. Thus, the diffusion plate 15 dims display light supplied from the light emission block 11 by means of the dimmer dots 15*a* before allowing the light to enter it. As pointed out above, the dimmer dots 15*a* are arranged in array and respectively disposed opposite to the LED 12. As they partly block display light entering it directly from the LEDs 12 and reflect it toward the reflection sheet 16, which will be described in greater detail hereinafter, incident light is prevented from partially increasing its luminance and made to uniformly strike the optically functional sheet laminate 13.

In the optical sheet block 10, display light emitted from the LEDs 12 is partly radiated around by the diffusion plate 15 in order to prevent high luminance sites from being generated locally when display light that partially shows a high capacity is made to directly strike the light diffusion/guide plate 14 as pointed out above. Thus, the optical sheet block 10 is adapted to improve the optical efficiency by causing display light radiated around by the diffusion plate 15 to be reflected toward the light diffusion/guide plate 14 by way of the diffusion plate 15 once again. The reflection sheet 16 is typically formed by molding a foaming PET (polyethylene terephthalate) material that contains a fluorescent agent. Foaming PET materials have the characteristics of a high reflectance of about 95% and of showing a color tone different from metal luster that makes scars on the reflection surface less remarkable. The reflection sheet 16 may alternatively be formed by silver, aluminum, stainless steel or the like that can show a mirror surface.

The optical sheet block 10 is also so designed that, as display light emitted from the LEDs 12 partly enters the diffusion plate 15, exceeding the critical angle thereof, the surface of the diffusion plate 15 reflects the entering display light. Thus, reflected light from the surface of the diffusion plate 15 and the part of display light emitted by the LEDs 12, radiated around and reflected by the reflection sheet 16 are reflected repeatedly between the diffusion plate 15 and the reflection sheet 16 to improve the reflectance due to the principle of intensification of reflection.

Now, the control device 20 for adjusting and controlling the light emission rate of the backlight unit will be described below by referring to FIG. 5.

Figure 5:
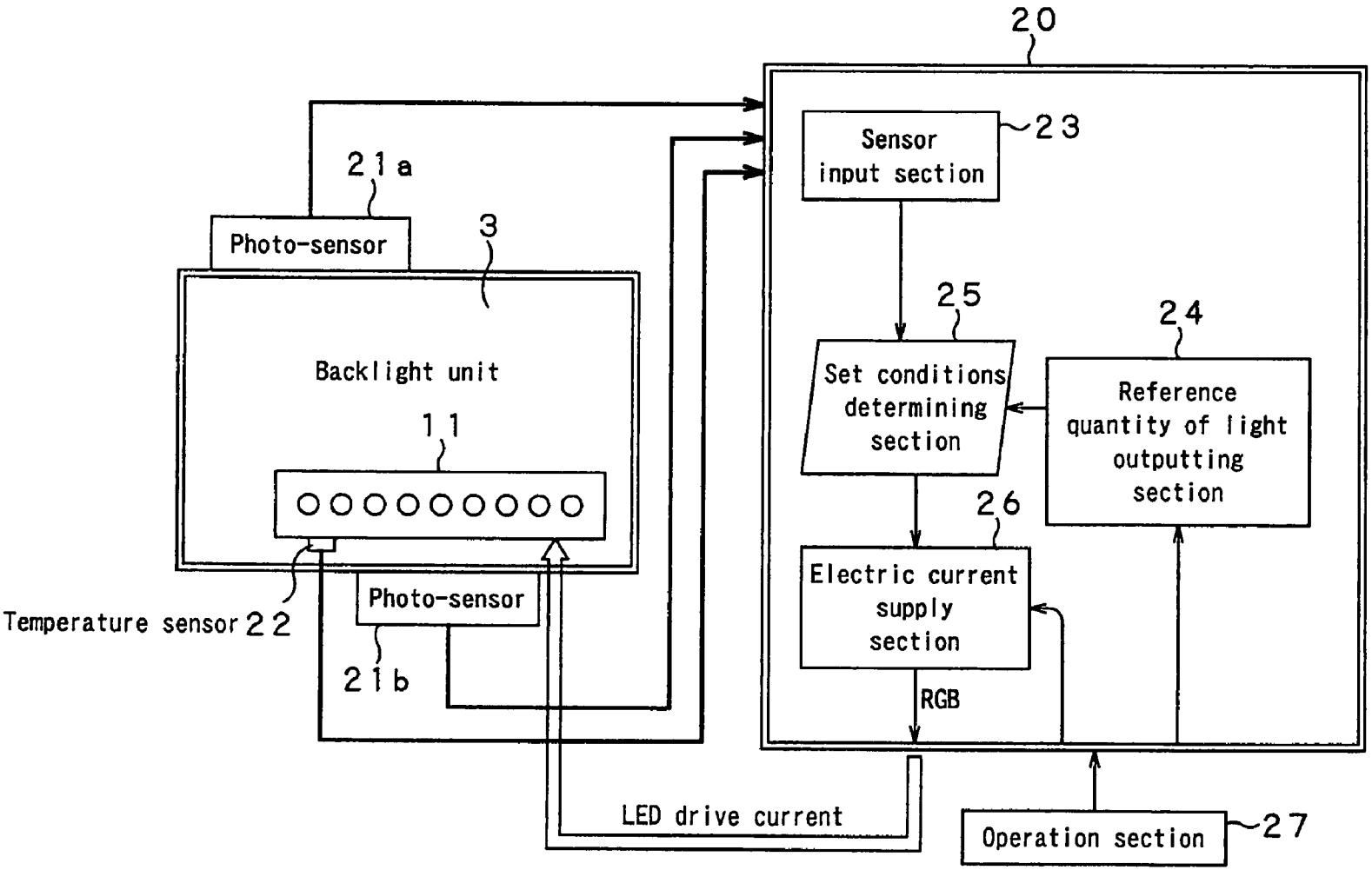
FIG. 5 is a schematic block diagram of a control device according to the invention for adjusting and controlling the quantity of emitted light of a backlight unit.

As shown in FIG. 5, the control device 20 comprises a pair of photo-sensors 21*a*, 21*b* for detecting the light emission rate of each of the LEDs 12, a temperature sensor 22 for detecting the quantity of heat of the backlight unit 3, a sensor input section 23 to be used for inputting the detected values of the photo-sensors 21*a*, 21*b* and the temperature sensor 22, a reference quantity of light outputting section 24 for outputting the quantity of emitted light that provides a reference for each LED 12, a set conditions determining section 25 for determining the conditions of backlight unit 3 to be set, an electric current supply section 26 for supplying an electric current to each LED according to the outcome of the determination of the set conditions determining section 25 and an operation section 27 for generating operation signals according to the operation of the user.

The photo-sensors 21*a*, 21*b* detect the light emission rate of each LED 12 and supply the detected light emission rate to the sensor input section 23.

The temperature sensor 22 detects the temperature of the backlight unit 3 and supplies the detected temperature to the sensor input section 23.

The reference quantity of light outputting section 24 supplies a quantity of light that provides a reference to each of the LEDs 12 of the light emission block 11 to the set conditions determining section 25.

The set conditions determining section 25 determines the flow rate of the electric current to be supplied to the blue LEDs 12*c* on the basis of the detected value of each LED 12 and the detected temperature of the backlight unit 3 input to it by way of the sensor input section 23 and the reference light emission rate of each LED 12 supplied from the reference quantity of light outputting section 24. Note that the electric current to be supplied to the blue LEDs 12*c* shows a constant value that is not changed by the temperature change, if any. Then, the set conditions determining section 25 determines the flow rate of the electric current to be supplied to the red LEDs 12*a* and the green LEDs 12*b* on the basis of the determined flow rate of the electric current to be supplied to the blue LEDs 12*c*. The set conditions determining section 25 supplies the electric current value determined for each LED 12 to the electric current supply section 26.

The electric current supply section 26 supplies electric currents to the backlight unit 3 according to the electric current value of each LED 12 supplied from the set conditions determining section 25.

The operation section 27 generates an operation signal according to the operation of the user and supplies the generated operation signal to the reference quantity of light outputting section 24 and the electric current supply section 26. The reference quantity of light outputting section 24 adjusts the reference quantity of light according to the operation signal supplied from the operation section 27 and in turn supplies the adjusted reference quantity of light to the set conditions determining section 25. The electric current supply section 26 adjusts the constant electric current that it supplies to the blue LEDs 12*c* according to the directive from the set conditions determining section 25 in response to the operation signal supplied from the operation section 27 and supplies the adjusted electric current to the backlight unit 3. The electric current supply section 26 also adjusts the electric current that it supplies to the red LEDs 12*a* and the green LEDs 12*b* according to the electric current it supplies to the blue LEDs 12*c* and supplies the adjusted electric current to the backlight unit 3.

Figure 6:
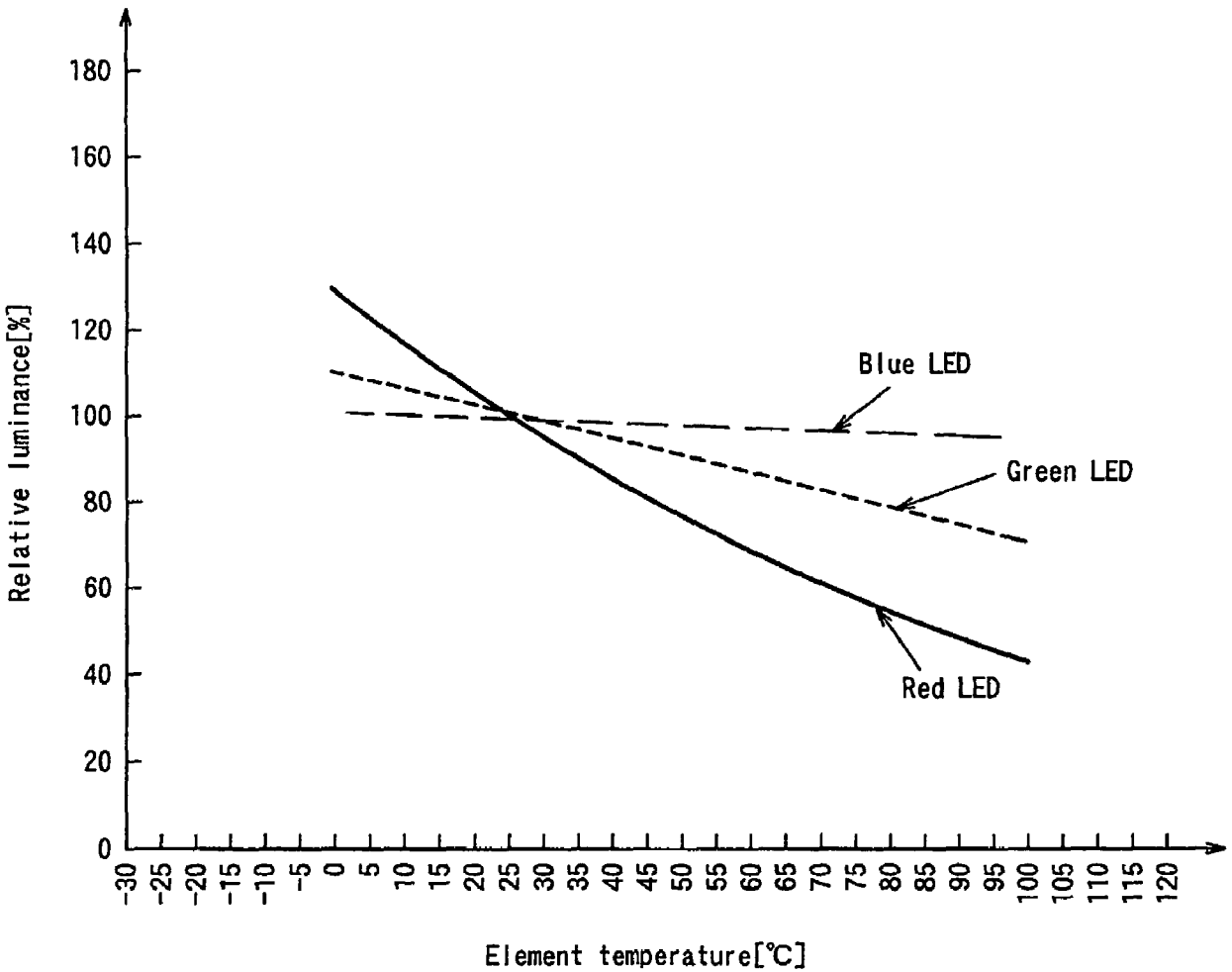
FIG. 6 is a graph illustrating the relationship between the temperature of the elements of each color and the relative luminance thereof.

The characteristics of blue LEDs 12*c* will be described below. As clearly seen from the graph of FIG. 6 illustrating the relationship between the temperature of the elements of each color and the relative luminance thereof, the luminance of blue LEDs 12*c* does not change substantially in response to any temperature change, whereas the luminance of red LEDs 12*a* and that of green LEDs 12*b* change remarkably in response to a temperature change.

On the other hand, blue LEDs 12*c* do not contribute significantly to the luminance of a liquid crystal display panel and hence blue LEDs 12*c* are scarcely used as references for adjustments. However, optical sensors can accurately and most sensitively detect blue light. Additionally, blue LEDs 12*c* are stable and free from dispersion in terms of degradation of luminance due to diminishing service life when compared with red LEDs 12*a* and green LEDs 12*b*. Still additionally, as for the temperature/luminance characteristic of blue LEDs 12*c*, the luminance of blue LEDs 12*c* increases by about 10% within a predetermined junction temperature range (between 35 and 95° C.) but changes in luminance can occur to this extent in light sources of television sets comprising a CCFL and are observed in television sets comprising a cathode ray tube as initial luminance drifts, and hence such changes are tolerable without a problem.

Figure 7:
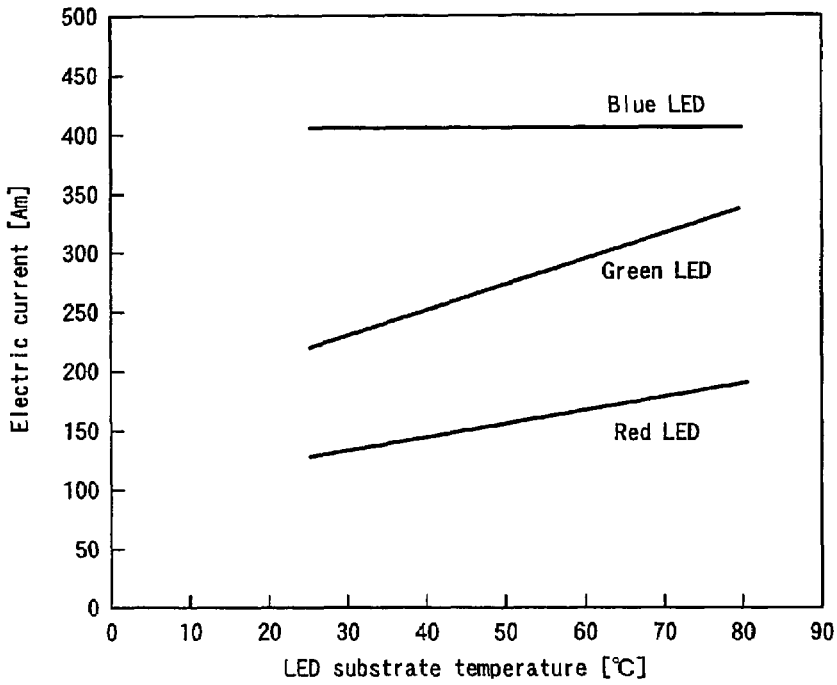
FIG. 7 is a graph illustrating the relationship between the temperature of the LED substrates of each color and the electric current supplied to the elements of the color.
Figure 8:
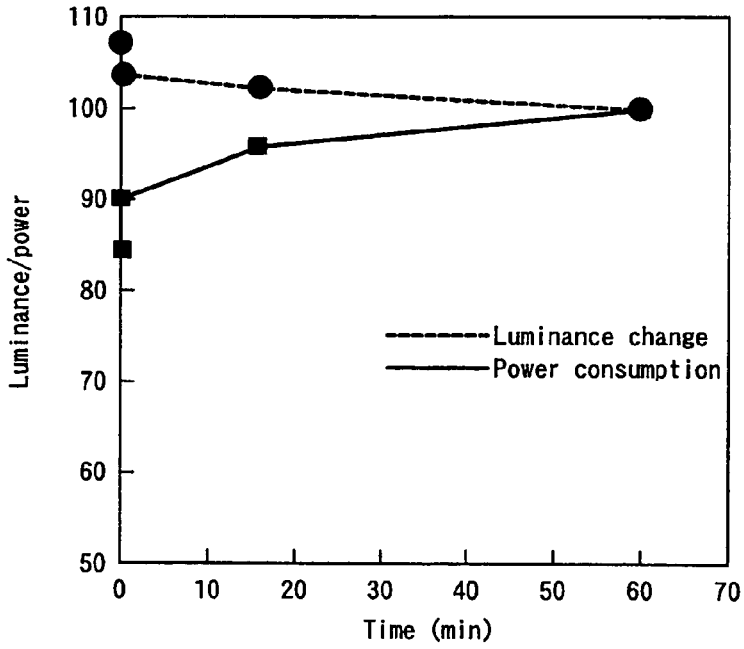
FIG. 8 is a graph illustrating the change with time of luminance after turning on the switch.

As seen from FIG. 7, the control device 20 adjusts the white balance on the basis of the fact that a constant electric current is supplied to the blue LEDs 12*c* and the electric current supplied to the green LEDs 12*b* and the red LEDs 12*a* increases as the temperature (of the LED substrate) rises.

Thus, it is possible to build a simple and stable feedback system for the control device 20 when it is adapted to conduct feedback operations for the electric current to be supplied to the red LEDs 12*a* and the green LEDs 12*b* in response to the detection output of the optical sensor for the blue LEDs 12*c*, while keeping the electric current supplied to the blue LEDs 12*c*, which show relatively little temperature changes, to a constant level.

Additionally, since the control device 20 can operate the red LEDs 12*a* and the green LEDs 12*b* under substantially equal conditions by selecting appropriate operating conditions for the blue LEDs 12*c*, it can grasp the service life of the backlight unit 3 simply by referring to the service life of the blue LEDs 12*c* without using any additional service life timer. Additionally, no excessive load is applied to the red LEDs 12*a* and the green LEDs 12*b* for feedback operations when the electric current supplied to the blue LEDs 12*c* is held to a constant level so that it is possible to secure a natural rising characteristic after the switch is turned on and also a natural service life degradation curve to consequently prolong the service life of the backlight unit 3.

The present invention is by no means limited to the embodiment as described above by referring to the accompanying drawings, which may be modified and altered in various different ways without departing from the scope of the present invention.

Thus, it should be understood by those skilled in the art that various modifications, combinations, sub-combinations and alterations may occur depending on design requirements and other factors insofar as they are within the scope of the appended claims or the equivalents thereof.

What is claimed is:

1. A control device for controlling a backlight unit having a group of light emitting elements including light emitting elements of red color, light emitting elements of green color and light emitting elements of blue color, the light emitting elements of different colors being electrically connected separately, the control device comprising:

electric current supply means for supplying a predetermined drive current to the group of light emitting elements;

quantity of emitted light detecting means for detecting the quantity of light emitted from the group of light emitting elements as a function of the electric current supplied from the electric current supply means;

temperature detecting means for detecting the temperature of the backlight unit;

reference quantity of light outputting means for outputting a reference quantity of light for the light emitting elements of each color; and control means for controlling the electric current supply means so as to make it supply a constant drive current to the light emitting elements of blue color according to the quantity of emitted light detected by the quantity of emitted light detecting means, the temperature detected by the temperature detecting means, and the reference quantity of light output from the reference quantity of light outputting means and supply a predetermined drive current to the light emitting elements of red color and those of green color according to the constant drive current supplied to the light emitting elements of blue color.

2. The device according to claim 1, further comprising:

operation signal generating means for generating a predetermined operation signal;

the electric current supply means being adapted to make the value of the constant drive current supplied to the light emitting elements of blue color variable to any electric current value under the control of the control means according to the operation signal and also the drive current supplied to the light emitting elements of red color and those of green color according to the electric current value made variable.

3. The device according to claim 2, wherein the operation signal generating means generates an operation signal for manipulating the luminance of the backlight.

4. The device according to claim 2, wherein the operation signal generating means generates an operation signal for manipulating the color temperature of the backlight.

5. A control device for controlling a backlight unit having a group of light emitting elements including light emitting elements of red color, light emitting elements of green color and light emitting elements of blue color, the light emitting elements of different colors being electrically connected separately, the control device comprising:

an electric current supply section that supplies a predetermined drive current to the group of light emitting elements;

a quantity of emitted light detecting section that detects the quantity of light emitted from the group of light emitting elements as a function of the electric current supplied from the electric current supply section;

a temperature detecting section that detects the temperature of the backlight unit;

a reference quantity of light outputting section that outputs a reference quantity of light for the light emitting elements of each color; and a control section that controls the electric current supply section so as to make it supply a constant drive current to the light emitting elements of blue color according to the quantity of emitted light detected by the quantity of emitted light detecting section, the temperature detected by the temperature detecting section, and the reference quantity of light output from the reference quantity of light outputting section and supply a predetermined drive current to the light emitting elements of red color and those of green color according to the constant drive current supplied to the light emitting elements of blue color.

* * * * *